US006556806B2

(12) United States Patent
Tsuruya et al.

(10) Patent No.: US 6,556,806 B2
(45) Date of Patent: Apr. 29, 2003

(54) IMAGE HEATING APPARATUS WITH HEATING MEMBER FACING IMAGE WHEN FORMED ON ONE SIDE AND BACKUP MEMBER ARRANGED AT OR ABOVE THE HEIGHT OF THE HEATING MEMBER, AND IMAGE FORMING APPARATUS CONTAINING SAME

(75) Inventors: Takaaki Tsuruya, Shizuoka (JP); Toru Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/925,470

(22) Filed: Aug. 10, 2001

(65) Prior Publication Data

US 2002/0044802 A1 Apr. 18, 2002

(30) Foreign Application Priority Data

Aug. 11, 2000 (JP) ..... 2000-244841
Aug. 9, 2001 (JP) ..... 2001-242762

(51) Int. Cl.[7] ..... G03G 15/20
(52) U.S. Cl. ..... 399/322
(58) Field of Search ..... 399/322, 323

(56) References Cited

U.S. PATENT DOCUMENTS 3,955,813 A * 5/1976 Edwards ..... 399/323 X
4,967,237 A * 10/1990 Sasaki et al. ..... 399/322
5,087,947 A * 2/1992 Torino ..... 399/322
5,325,164 A * 6/1994 Tai et al. ..... 399/322
5,422,710 A * 6/1995 Shirosaka et al. ..... 399/322
5,493,380 A 2/1996 Saitou et al. ..... 355/290
5,568,240 A 10/1996 Ohtsuka ..... 355/285
5,745,833 A 4/1998 Abe et al. ..... 399/330
6,049,691 A 4/2000 Abe et al. ..... 399/330
6,078,760 A * 6/2000 Abe et al. ..... 399/322 X
6,101,365 A * 8/2000 Nishikawa ..... 399/322 X
6,298,214 B1 * 10/2001 Koga ..... 399/322

FOREIGN PATENT DOCUMENTS

JP 07-114276 5/1995

* cited by examiner

*Primary Examiner*—Fred L. Braun
(74) *Attorney, Agent, or Firm*—Fitzpatrick, Cella, Harper & Scinto

(57) ABSTRACT

An image heating apparatus for heating an image formed on a recording material includes a heating member, a backup member that cooperates with the heating member to form a nip for nipping and conveying the recording material, and a conveying member provided downstream of the nip in the traveling direction of the recording material. In such a construction, the conveying member is provided closer to the backup member than the heating member.

6 Claims, 9 Drawing Sheets

IMAGE HEATING APPARATUS WITH HEATING MEMBER FACING IMAGE WHEN FORMED ON ONE SIDE AND BACKUP MEMBER ARRANGED AT OR ABOVE THE HEIGHT OF THE HEATING MEMBER, AND IMAGE FORMING APPARATUS CONTAINING SAME

BACKGROUND OF THE INVENTION

1. Field of the Invention

The present invention relates to an image heating apparatus such as a fixing device mounted in an image forming apparatus such as a copier or printer, and an image forming apparatus having the image heating apparatus.

2. Related Background Art

With recent trends in the design of image forming apparatuses such as electrophotographic printers toward high-speed, multifunctional, full-color features, various types of printers with these features have already hit the market. From the high-speed printer's point of view, research and development of image forming apparatuses adopting an in-line system have made progress. The in-line system is such that a plurality of electrophotographic units different in color with one another are so arranged in series that they will be driven at the same time, which makes it possible to form color images faster. Such in-line type image forming apparatuses have great potential for business use.

Because of less process components, which make it easy to provide a compact, cheap apparatus, many conveying belt type in-line printers have been developed. The conveying belt type in-line system is such that a plurality of electrophotographic units, each of which incorporates plural electrophotographic processes such as electrification, exposure, development and cleaning therein, are so disposed that they sequentially overlap and transfer toner images onto a transferring material (recording paper) while sucking the transferring material on a conveying belt that also serves as a transfer belt.

FIG. 5 illustrates a structure of an in-line type image forming apparatus. In the image forming apparatus, process stations 20M, 20C, 20Y and 20K for yellow (Y), magenta (M), cyan (C) and black (K) are placed horizontally in a line along the circumferential surface of a transferring material conveying belt (ETB) 1 wound around a driving roller 2 and a tension roller 3.

In each process station 20 (20M-20K), an electrifier 7 uniformly electrifies the surface of a photosensitive drum 6, and an exposing optical system 8 forms a latent image on the surface. The latent image is developed by a developing device 9 and visualized as a toner image. The toner image in each color formed on the photosensitive drum 6 is transferred by a transferring roller 4 to the surface of a transferring material on a conveying belt 1 in a transferring portion opposite to the photosensitive drum 6, thus superimposing four-color toner images on the transferring material to form a color image. Residual toner remaining on the photosensitive drum 6 after the transfer of each toner image is scraped by a cleaner 10, cleaning up the surface of the photosensitive drum 6.

The transferring material is fed from a sheet feeding cassette 14 to the conveying belt 1 by means of pickup rollers 15. Then, when passing through a nip portion formed between an absorbing roller 5 and the tension roller 3, the transferring material is applied with a bias voltage and electrostatically attracted to or absorbed on the conveying belt 1. The transferring material absorbed on the conveying belt 1 is conveyed in the horizontal direction of arrow by means of the conveying belt 1.

The transferring material to which four-color toner images have been transferred is separated from the conveying belt 1 in a downstream rear-end portion of the conveying belt 1 along a curvature, and conveyed to a fixing apparatus 11 by which the toner images are fixed. The fixing apparatus 11 includes a heating roller 121 with a halogen heater 121*a*, a fixing part 12 with a pressure roller 122 made in contact with the heating roller 121, and a sheet discharging part 13 consisting of a pair of sheet discharging rollers 131 and 132.

While the transferring material is being nipped and conveyed by a fixing nip portion between the heating roller 121 and the pressure roller 122, the four-color toner images are fixed by the application of heat and pressure. The transferring material on which the toner images have been fixed by the fixing part 12 is delivered to the outside of the fixing apparatus 11 by means of the sheet discharging part 13, and finally placed or stacked on a sheet discharging tray 16.

In addition to the above-mentioned horizontally conveying type in-line printer, a vertically conveying type in-line printer has also been developed for the purpose of reducing the installation area. The vertically conveying type in-line printer assumes such a form that the horizontally conveying type in-line printer of FIG. 5 is rotated 90 degrees. In the horizontally conveying type in-line printer, the transferring material absorbed on the transferring belt is conveyed upward against gravity while transferring toner images in respective colors from respective process stations to the transferring material, thus forming a full-color image. The full-color image is then heat-fixed by the fixing apparatus placed at the upper side of the apparatus.

One of salient features required for color printers is the transparency of an image to be printed out on an OHP (Over Head Projector) sheet.

The OHP sheet is a synthetic resin film, for example, PET film, of about 100 $\mu$m in thickness. Since the OHP sheet has a larger heat capacity than normal paper, it needs to be fixed by a larger amount of heat than usual. In order to achieve excellent transparency, it is necessary to fuse toner images on the OHP sheet securely enough to make the surface of the toner images smooth. Therefore, upon fixing the toner images transferred to the surface of the OHP sheet, the fixing temperature is increased, or the conveying speed during a fixing period is slowed down so that the amount of heat to be applied per unit time will increase.

In the horizontally conveying type in-line printer, where the electrophotographic units are placed in the horizontal line, the fixing apparatus and the conveying belt are arranged side by side, positioning the heating roller on the pressure roller in the fixing apparatus. Therefore, as shown in FIG. 6, an OHP sheet S softened by heat applied when passing through the fixing nip portion turns downward in a delivery direction by its own weight, that is, toward the pressure roller 122 side, and discharged to the outside of the apparatus by means of pair of sheet discharging rollers 131, 132 through a bent path as indicated by the solid line Ts.

On the other hand, in the vertically conveying type in-line printer, where the electrophotographic units are placed in the vertical line, the fixing apparatus 11 is placed above the conveying belt, and as shown in FIG. 7, the sheet discharging part 13 is positioned right above the fixing part 12 in the fixing apparatus 11. In this case, since the OHP sheet S is conveyed substantially in the vertical direction in the fixing nip portion, such an effect of the horizontally conveying type that it lets the OHP sheet turn its delivery direction down toward the pressure roller 122 side by its own weight. As a result, as shown in FIG. 7, the delivery direction might unsteadily form, other than a path T0, a path T1 bent on the heating roller 121 side or a path T2 bent on the pressure roller 122 side.

If the OHP sheet passes through the path T1 on the heating roller 121 side, one side of the OHP sheet on which toner images are borne is brought into contact with the heating roller 121 for a long time. In this case, it was found that the smoothness of the surface of the toner images would be spoilt, resulting in occurrence of such a phenomenon as to make the transparency of the resulting image fixed on the OHP sheet worse (hot offset).

The hot offset can be prevented by lowering the fixing temperature. In this case, however, if the OHP sheet S forms the path T2 bent on the pressure roller 122 side, toner is not melted enough, thereby making the transparency worse.

To eliminate the formation of the above-mentioned paths, pressure between the sheet discharging rollers 131 and 132 can be so increased that the OHP sheet S after passing through the fixing nip portion is kept pulled to take the path T0. In this case, however, it was also found that the increase in the pressure between the sheet discharging rollers spoilt the smoothness of the surface of the toner images on the OHP sheet, and hence made the transparency worse.

As discussed above, although the vertically conveying type in-line printer has the advantage of reducing the installation area of the apparatus, it was found that it tended to lower the transparency of the toner images on the OHP sheet, compared to the horizontally conveying type, unless the sheet discharging angle was aggressively determined.

SUMMARY OF THE INVENTION

The present invention has been made in consideration of the above-mentioned conventional problems, and it is an object thereof to provide an image heating apparatus and an image forming apparatus provided with the image heating apparatus capable of preventing occurrence of a fixing failure.

It is another object of the present invention to provide an image heating apparatus and an image forming apparatus provided with the image heating apparatus capable of forming on a transparent recording material an image with excellent transparency.

It is still another object of the present invention to provide an image heating apparatus comprising:

a heating member;

a backup member that cooperates with the heating member to form a nip for nipping and conveying a recording material; and a conveying member provided downstream of the nip in a traveling direction of the recording material, wherein the conveying member is provided closer to the backup member than the heating member.

It is yet another object of the present invention to provide an image forming apparatus comprising:

fixing means having a nip for nipping and conveying a recording material, the fixing means including a heating member and a backup member that cooperates with the heating member to form the nip for nipping and conveying the recording material; and a conveying member provided downstream of the nip in a traveling direction of the recording material, wherein the conveying member is provided closer to the backup member than the heating member.

Further and other objects of the present invention will become apparent from reading the following detailed description in connection with the accompanying drawings.

DETAILED DESCRIPTION OF THE PREFERRED EMBODIMENTS

Image forming apparatuses according to the present invention will be described in detail with reference to the accompanying drawings.

First Embodiment

Figure 1:
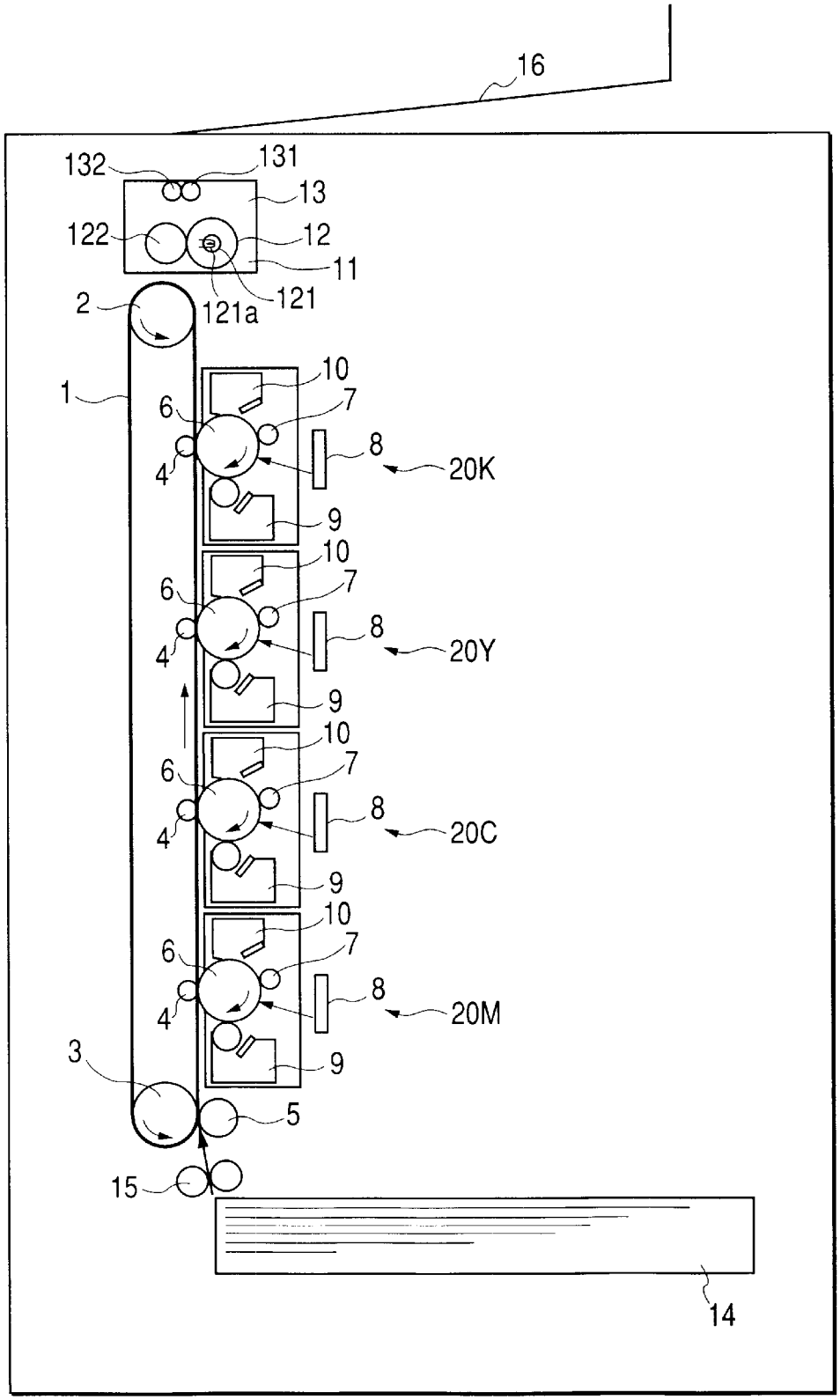
FIG. 1 is a sectional view illustrating an image forming apparatus according to one preferred embodiment of the present invention.

FIG. 1 is a sectional view illustrating an image forming apparatus according to one preferred embodiment of the present invention.

The image forming apparatus includes a transferring material conveying belt (ETB) 1 wound around a driving roller 2 and a tension roller arranged vertically at the upper and lower sides, respectively. Four-color process stations 20M, 20C, 20Y and 20K for yellow (Y), magenta (M), cyan (C) and black (K) are disposed vertically in a line along the circumferential surface of the conveying belt 1. In each process station, a photosensitive drum (drum-shaped photosensitive member) 6 is in contact with a transferring roller 4 through the conveying belt 1.

An absorbing roller 5 is placed upstream of the process station 20M and at the lower end portion of the conveying belt 1. The absorbing roller 5 is in contact with the tension roller 3 through the conveying belt 1. Here, the tension roller 3 also serves as an opposite absorbing roller. A fixing apparatus 11 is placed at the upper side of the conveying belt 1.

In operation, a transferring material (recording material) is fed from a sheet feeding cassette 14 to a conveying belt 1 by means of pickup rollers 15. Then, when passing through a nip portion formed between the absorbing roller 5 and the tension roller 3, the transferring material is applied with a bias voltage and electrostatically attracted to or absorbed on the conveying belt 1. The transferring material absorbed on the conveying belt 1 is conveyed upward in the vertical direction by means of the conveying belt 1.

During the image forming process, an electrifier 7 uniformly electrifies the surface of a photosensitive drum 6 mounted in each process station 20 (20M-20K), and an exposing optical system 8 forms a latent image on the surface. The latent image on the photosensitive drum 6 is developed by a developing device 9 and visualized as a toner image. The toner image in each color is transferred by a transferring roller 4 to the transferring material on the conveying belt 1. Residual toner remaining on the photosensitive drum 6 after the transfer of the toner image is scraped by a cleaner 10, cleaning up the surface of the photosensitive drum 6.

A reverse developing system generally employed uses an OPC photosensitive member having negative polarity as the photosensitive drum. In the system, since the latent image is developed with negative toner, the transferring roller 4 is applied with a positive transferring bias voltage from a bias voltage power supply, not shown. A low-resistant roller is used for the transferring roller 4.

The image forming process is actually carried out by taking into account the traveling speed of the conveying belt 1 and the distance between transferring positions of the process stations. In other words, the transferring material is so conveyed that formation and transfer of each toner image is performed by each process station at such timing that positions of toner images with respective colors to be transferred to the transferring material accord with one another. Then, while the transferring material once passes through all the process stations 20M to 20K for magenta, cyan, yellow and black, four-color toner images are superimposed one upon another and transferred to the surface of the transferring material, thus forming a color image.

The transferring material on which the color image has been formed is separated from the conveying belt 1 in an upper end portion, that is, in a downstream end portion of the conveying belt 1 along a curvature, and conveyed to a fixing apparatus 11 by which the color image is fixed. The fixing apparatus 11 includes a fixing part 12 arranged on a transferring-material conveying path of the conveying belt 1, and a sheet discharging part 13 arranged above the fixing part 12.

The fixing part 12 comprises a heating roller 121 with a halogen heater 121*a*, and a pressure roller 122 made in contact with the heating roller 121. In the embodiment, the heating roller 121 and the pressure roller 122 cooperate with each other to form a nip portion in the vertical direction. While the transferring material to which the toner images have been transferred is being nipped and conveyed between the heating roller 121 and the pressure roller 122, the fixing apparatus 11 fuses toner and fixes the toner images onto the transferring material by the application of heat and pressure. The fixed transferring material is then delivered onto a sheet discharging tray 16 along guides, not shown.

For proper fusing and fixing of toner, a contact nip needs to be provided between the heating roller 121 and the pressure roller 122. Therefore, each of the rollers 121 and 122 is made up by providing an elastic layer of silicon rubber around a metal core made of aluminum or the like. Further, to prevent toner or paper dust from adhering to the surfaces of the rollers 121 and 122, the uppermost surface layers of the rollers are coated with resin having good mold releasing properties such as PFA or PTFE.

The sheet discharging part 13 consists of a pair of sheet discharging rollers 131 and 132 provided at the upper end portion of the fixing part 12. The transferring material on which the toner images have been fixed while passing through the fixing part 12 is delivered to the outside of the fixing apparatus 11 through the sheet discharging part 13, and finally placed or stacked on the sheet discharging tray 16.

The sheet discharging roller 132 is driven by a driving apparatus, not shown, to rotate at a peripheral speed 3% faster than the fixing part 12. The discharging roller 131 is driven by the rotation of the roller 132. A force to be applied between the sheet discharging roller pair (a force to nip or sandwich the transferring material) is set smaller enough than that in the fixing part 12. The sheet discharging roller 131 that is brought into contact with the image surface needs to be prevented from adhesion of toner or paper dust, and therefore, it is made of fluorine based resin capable of displaying excellent mold releasing performance and surface smoothness such as PFA or PTFE. On the other hand, the sheet discharging roller 132 that is never brought into direct contact with the image surface is made of a heat-resistant material such as silicon rubber.

Figure 2:
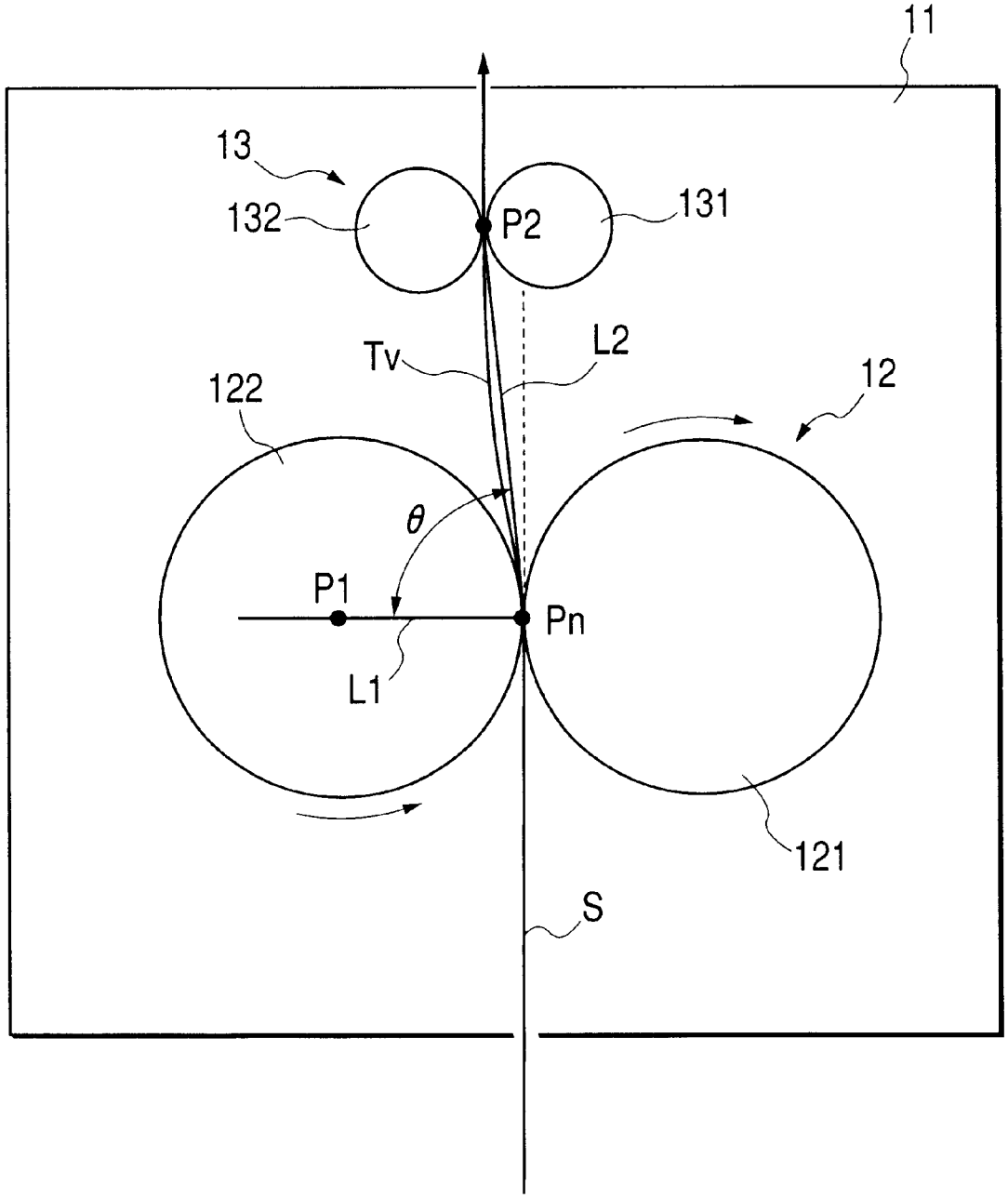
FIG. 2 is a sectional view illustrating a fixing apparatus mounted in the image heating apparatus of FIG. 1.

In the embodiment, the fixing apparatus allows for use of an OHP sheet as the transferring material. As shown in FIG. 2, the position of the fixing part 12 relative to the sheet discharging part 13 is so set that it can prevent deterioration of the transparency of the toner image sided surface of the OHP sheet due to long-time contact with the heating roller 121, that is, deterioration of the transparency of the image due to a hot offset.

In FIG. 2, the center point of the nip portion at which the heating roller 121 is in contact with the pressure roller 122 is Pn. A line drawn from Pn in a direction perpendicular to the conveying direction of the transferring material toward the pressure roller 122 side is L1 (where L1 passes through the center P1 of the pressure roller 122). A line drawn from Pn toward the center point P2 of the contact portion between the sheet discharging roller pair 131 and 132 is L2. Here, if an angle of positioning the sheet discharging part 13 relative to the fixing part 12 is θ, the angle θ of position is 90 degrees in the conventional, but less than 90 degrees in the embodiment.

The leading end portion of an OHP sheet S discharged from the fixing nip rises substantially in the vertical direction and strikes on the discharging roller 131. At this time, since the sheet discharging roller 132 is driven, the leading end portion of the OHP sheet S is introduced into the nip between the sheet discharging roller pair of the sheet discharging part 13. The peripheral speed of the sheet discharging part 13 is set faster than that of the fixing part 12, and the force to be applied between the sheet discharging roller pair of the sheet discharging part 13 is set smaller enough than that in the fixing part 12. Therefore, the OHP sheet S is never bent between the fixing part 12 and the sheet discharging part 13 as well as not forcibly pulled upward from the fixing nip. Since the angle θ of position of the sheet discharging part 13 relative to the fixing part 12 is set less than 90 degrees, the OHP sheet S is steadily delivered while forming a path Tv tilted to the pressure roller 121 side until the trailing end of the OHP sheet comes out of the nip. Thus the OHP sheet S is prevented from being unsteadily bent on the heating roller 122 side and overheated. This makes it possible to prevent deterioration of the transparency of an image due to deterioration of the smoothness of the toner image sided surface, that is, deterioration of the transparency of the image due to a hot offset.

In the above-mentioned embodiment, the fixing apparatus is such that the angle θ of positioning the sheet discharging part relative to the fixing part is set less than 90 degrees. One surface of the OHP sheet to which the toner images have been transferred while being conveyed upward in the vertical direction by means of the transferring material conveying means can be prevented from being subjected to a hot offset caused by the fixing means overheating the surface. Thus an excellent color fixed image on the OHP sheet can be obtained even in a vertically conveying in-line printer capable of reducing the installation area.

Second Embodiment

Figure 3:
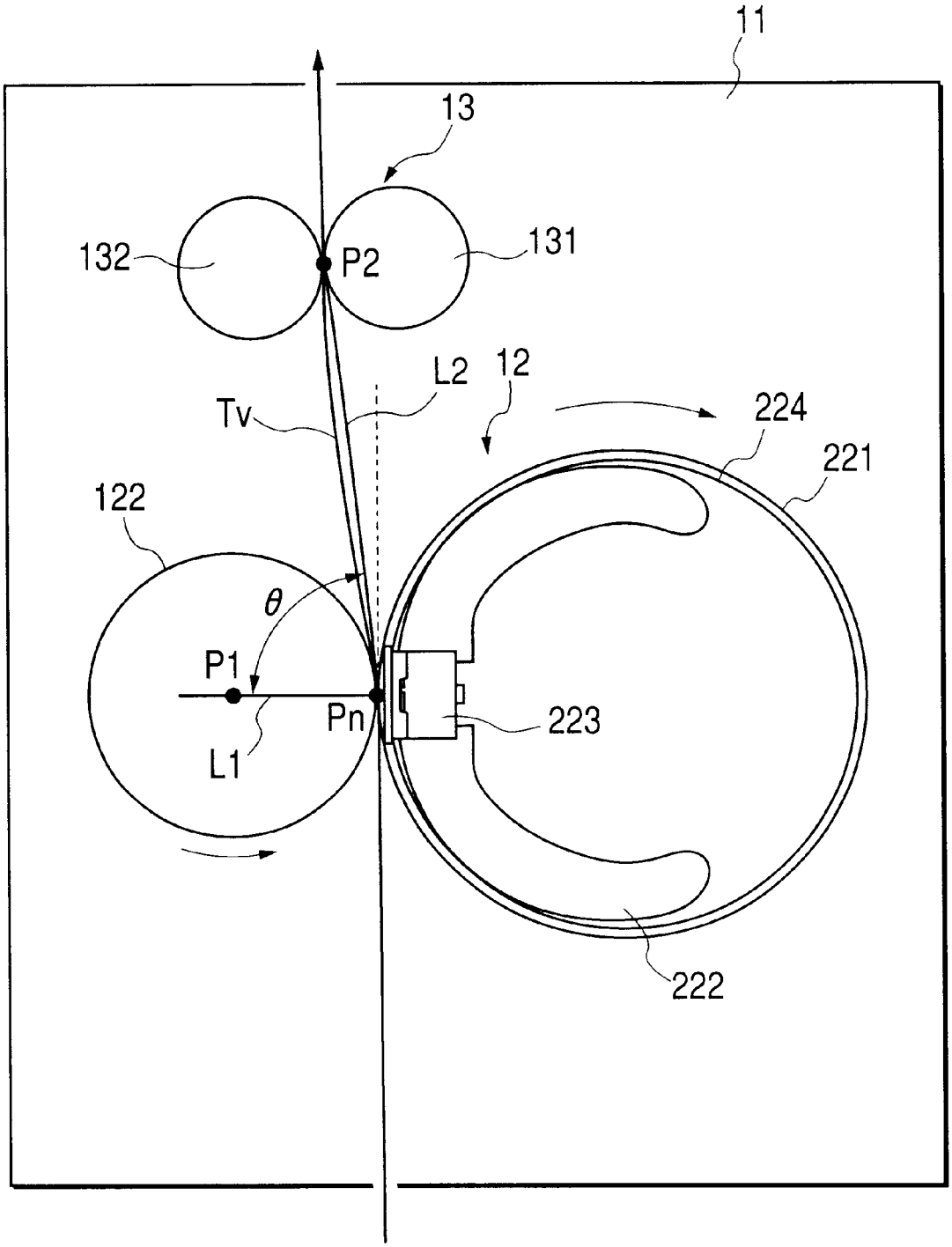
FIG. 3 is a sectional view illustrating a fixing apparatus according to a second embodiment of the present invention.

FIG. 3 is a sectional view illustrating a fixing apparatus according to another embodiment of the present invention. This embodiment features use of a film heating system for the fixing part of the fixing apparatus.

Lately, film heating type apparatuses have become commercially practical as a fixing apparatus for fixing toner images onto a transferring material in terms of quick start and energy conservation.

As shown in FIG. 3, this film heating type of fixing apparatus includes a heating member 224 around which a cylinder-shaped heat-resistant film (fixing film) 221 is provided. The film 221 is internally supported along its sliding surface by a supporting member 222, and a heating body 223 such as a ceramic heater as a heat source is placed inside the film 221. The film 221 is brought into contact with the pressure roller 122 in a position where the heating body 223 is placed to form a fixing nip portion. The film 221 is made up by coating, with a mold releasing layer such as PFA or PTFE, a base resin material having excellent heat resistance such as polyimide or the like. In operation, the transferring material to be fixed is introduced into the nip portion between the film and the pressure roller 122, nipped therebetween and conveyed together with the film. In the nip portion, heat from the heating body 223 is applied to the transferring material through the film while applying pressure to the transferring material, thus heat-fixing toner images on the transferring material.

In the embodiment, the fixing apparatus 11 comprises a fixing part 12 consisting of the above-mentioned heating member 224 and the pressure roller 122, and the sheet discharging part 13 consisting of a pair of sheet discharging rollers 131 and 132. The fixing apparatus 11 is placed at the upper side of the conveying belt 1 in the vertically conveying type in-line printer of FIG. 1. The fixing part 12 is placed above the transferring material conveying path of the conveying belt 1, and the sheet discharging part 13 is placed above the fixing part 12. In the embodiment, a fixing nip portion between the film 221 and the pressure roller 122 of the heating member 224 is formed in the vertical direction. In FIG. 3, reference numerals identical to those in FIG. 2 designate the same portions.

One form of the film heating systems is disclosed in Japanese Patent Application Laid-Open No. 07-114276. This publication describes an induction heating type fixing apparatus that induces a current in a fixing film by means of a magnetic flux to heat the fixing film. This apparatus uses Joule heat generated by the induced current to directly heat the fixing film, which makes it possible to realize a highly efficient fixing process.

Such a film heating type of fixing apparatus has the advantage, over the heat roller type, of reducing waiting time from the power is turned on until the image forming process becomes executable as well as savings of power consumption during a standby period.

However, it was found that the use of the film heating system for the vertically conveying type in-line printer makes the transparency of the OHP sheet images worse due to an hot offset than the heat roller system.

In the heat roller system, the shape of the heating roller as the heating member just behind the nip is stable, while in the film heating system, the film near the end of the nip may vary in shape. Variations in the shape of the film runs the danger of bring the heated film into contact with the OHP sheet for a longer time than that in the heat roller system. In such a case, the level of a hot offset caused by toner images on the OHP sheet coming in contact with the heating member long time is made worse than that in the heat roller system.

To prevent such a hot offset in the film heating system, the heating member needs to be separated from the toner-image sided surface faster than in the heat roller system.

In the embodiment, the fixing apparatus 11 having the film heating type fixing part of FIG. 3 was adopted for the vertically conveying type in-line printer of FIG. 1 to check out a relationship between an angle θ of positioning the sheet discharging part 13 relative to the fixing part 12 of the fixing apparatus 11 and deterioration of the transparency of an image on the OHP sheet due to a hot offset. The checking results are shown in the following table 1. In the table 1, "A" indicates that the transparency was deteriorated due to a hot offset, while "B" indicates that the transparency was not deteriorated.

TABLE 1

| θ (degree) | 89 | 87 | 85 | 83 | 81 | 79 | 77 |
|---|---|---|---|---|---|---|---|
| hot offset | A | A | B | B | B | B | B |

In the hot roller type fixing apparatus as shown in the first embodiment, the hot offset can be prevented by setting the angle θ of position less than 90 degrees. In contrast, the film heating type fixing apparatus used in this embodiment may case a hot offset even if the angle θ is set less than 90 degrees. However, it is apparent from the table 1 that no hot offset occurs even in the film heating system in such cases that the angle θ is set equal to or less than 85 degrees.

To sum up, the film heating type fixing apparatus adopted for the vertically conveying type in-line printer can also achieve both excellent transparency of images on an OHP sheet and recent requirements for quick start and energy conservation by setting the angle θ equal to or less than 85 degrees.

Figure 4:
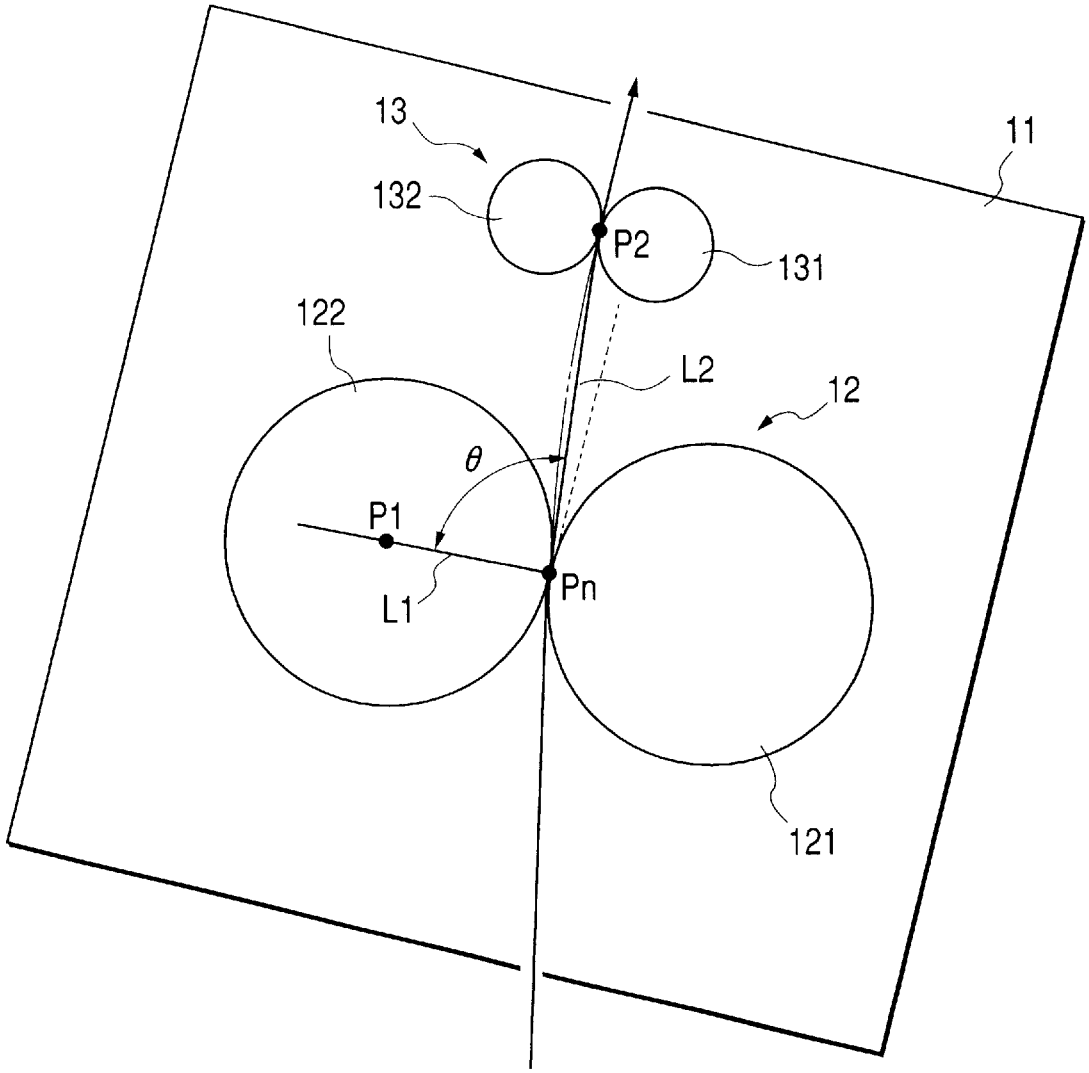
FIG. 4 is a sectional view illustrating a fixing apparatus to which the present invention is applicable.
Figure 5:
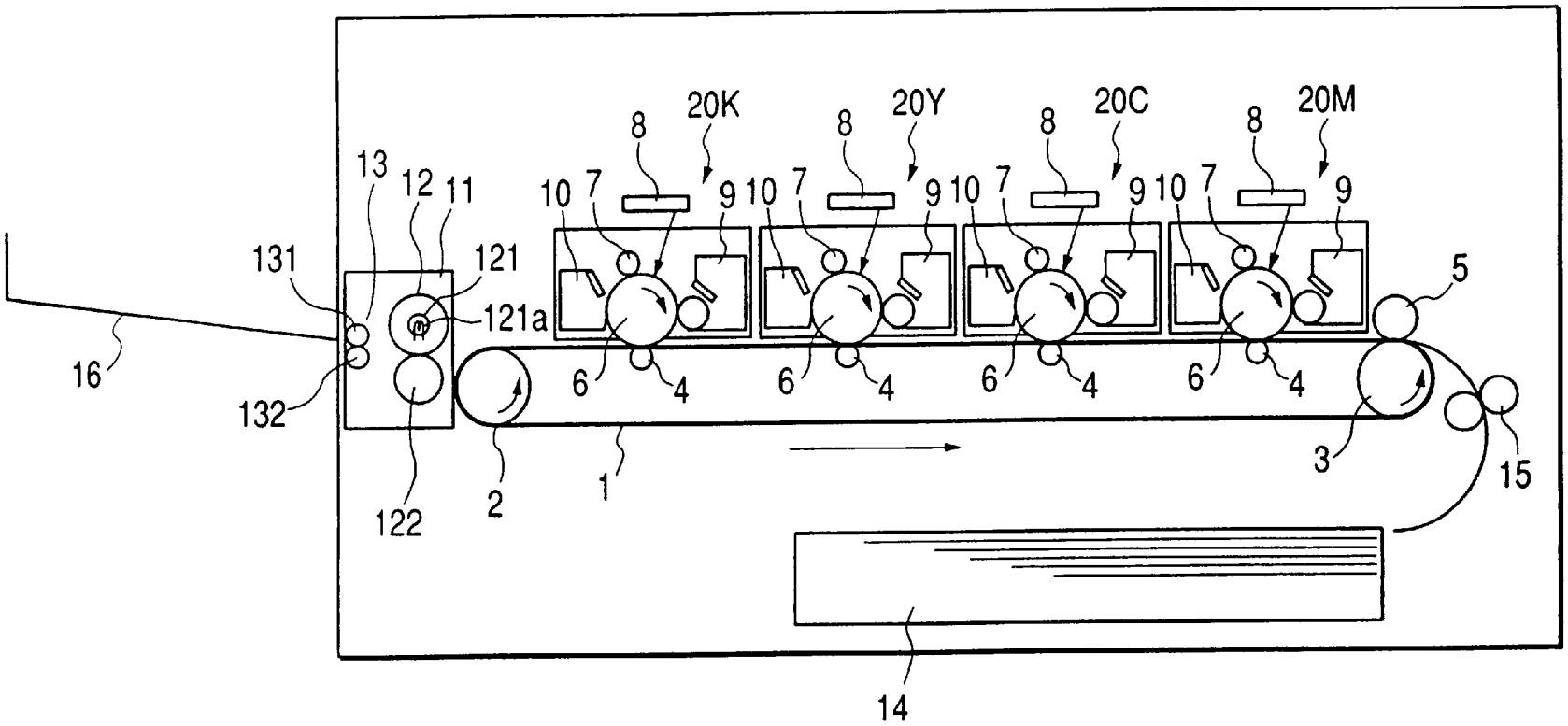
FIG. 5 PRIOR ART
FIG. 5 is a sectional view illustrating a conventional image forming apparatus.
Figure 6:
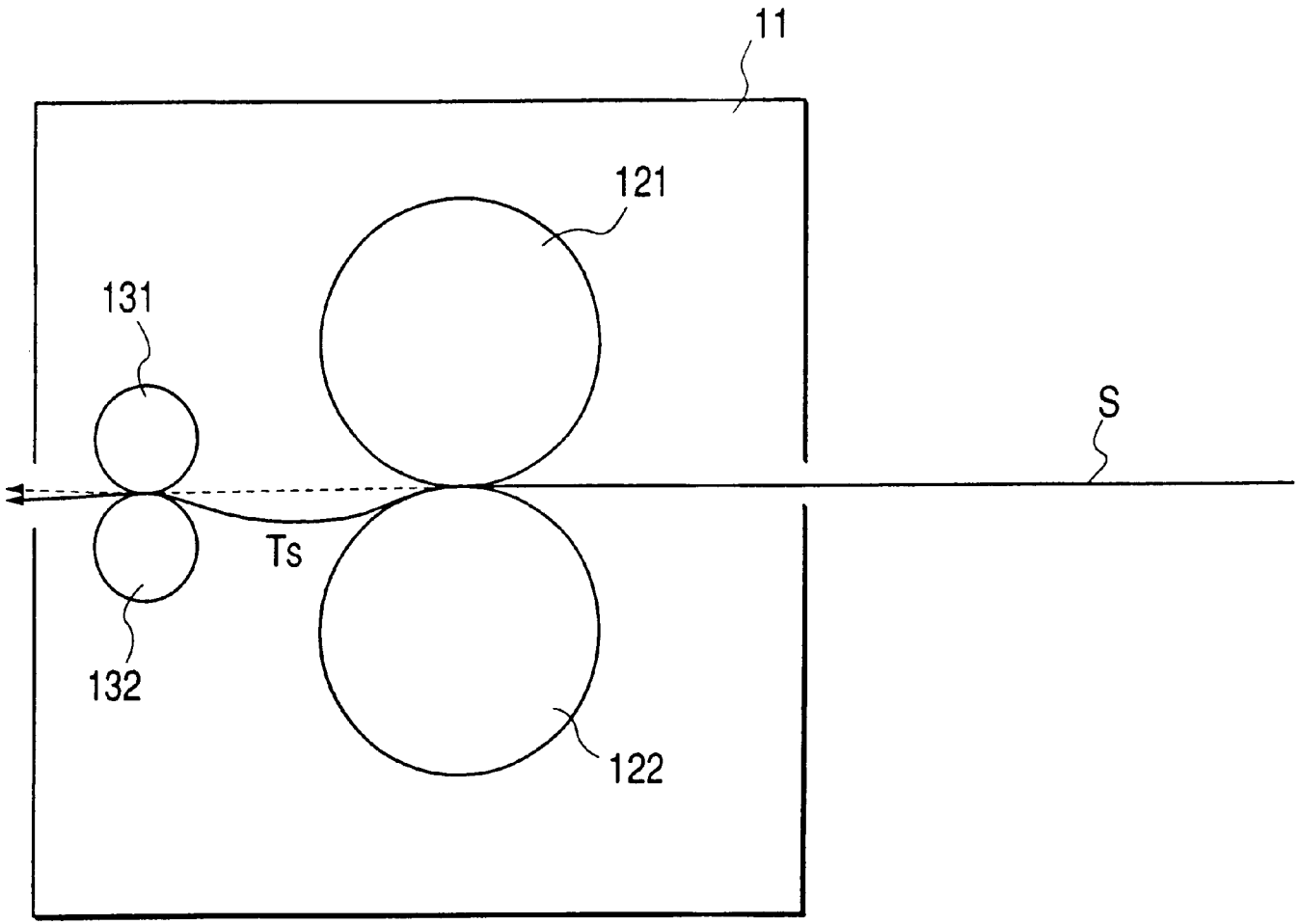
FIG. 6 PRIOR ART
FIG. 6 is a sectional view illustrating a fixing apparatus mounted in the image forming apparatus of FIG. 5.
Figure 7:
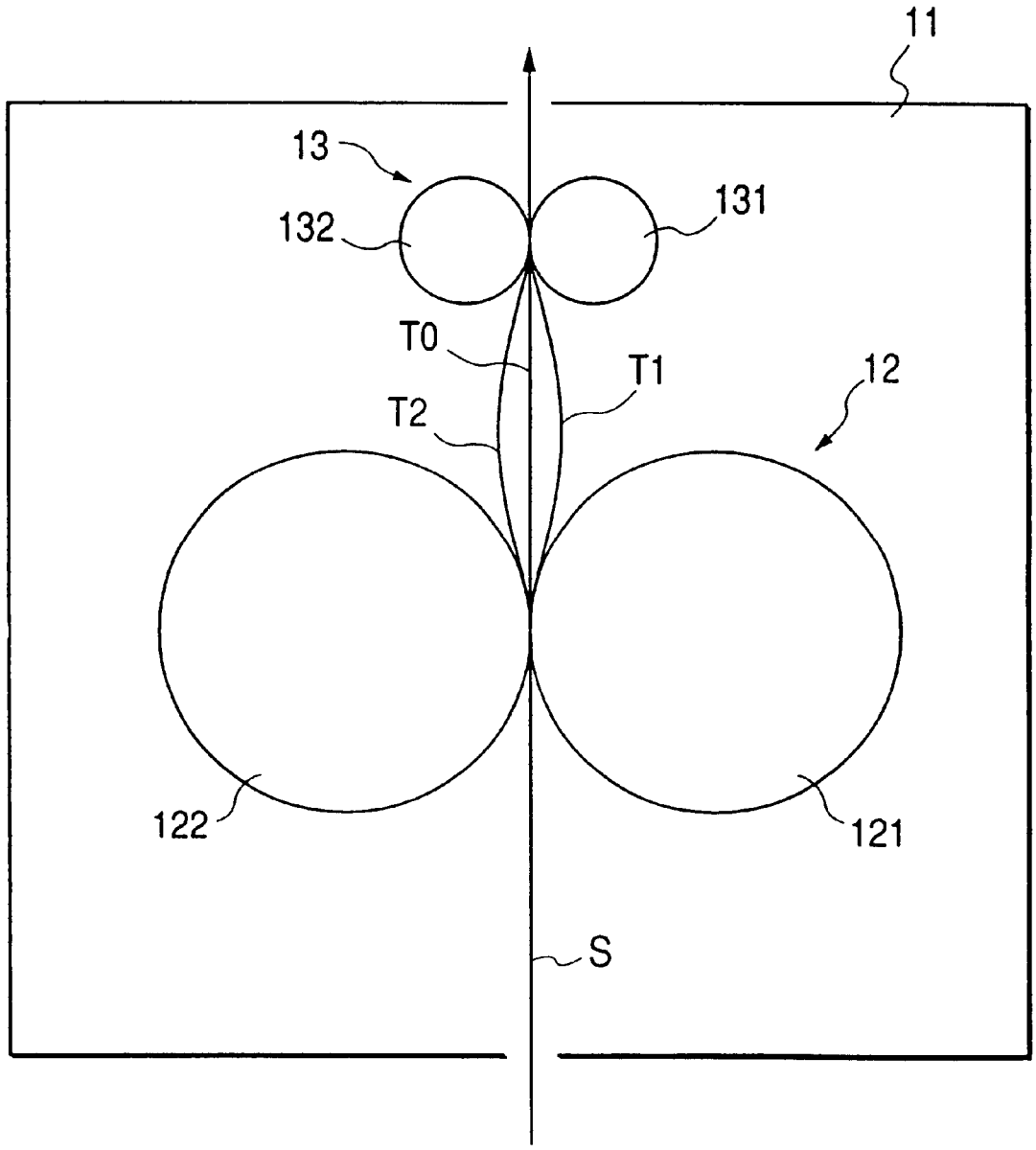
FIG. 7 PRIOR ART
FIG. 7 is a sectional view illustrating a fixing apparatus mounted in a conventional image forming apparatus of a vertically conveying type.

The above-mentioned embodiments both illustrated such a case that the fixing nip of the fixing part 12 of the fixing apparatus 11 is formed in the vertical direction. However, another arrangement as shown in FIG. 4 is also known, which makes it easy to discharge the transferring material after transfer to the upper side of the image forming apparatus. In this case, the entire fixing apparatus 11 is tilted to the heating roller 121 side so that the path of the transferring material from the fixing part 12 (the fixing nip portion of the fixing part 12) to the sheet discharging part 13 will be tilted to the heating roller 121 side.

Even if the fixing apparatus 11 is tilted in such a manner, the OHP sheet discharged can be separated faster enough from the surface of the heating roller 121 by setting the angle θ of positioning the sheet discharging part 13 relative to the fixing part 12 smaller. Thus sufficient transparency of images on the OHP sheet can be obtained without occurrence of a hot offset.

Third Embodiment

In the first and second embodiments, the fixing nip of the fixing part 12 of the fixing apparatus 11 is formed in the vertical direction. In this case, the transferring material conveying direction needs to be bent 90 degrees when the transferring material is delivered to the sheet discharging tray 16 for placing or stacking the transferring material discharged from the fixing apparatus 11 on the sheet discharging tray 16. A sharp turn in the path of the transferring material causes the transferring material to curl. Therefore, it is preferable to make the conveying path trace a gentle curved shape to some degree. It is also preferable to make the entire apparatus low in height.

Figure 8:
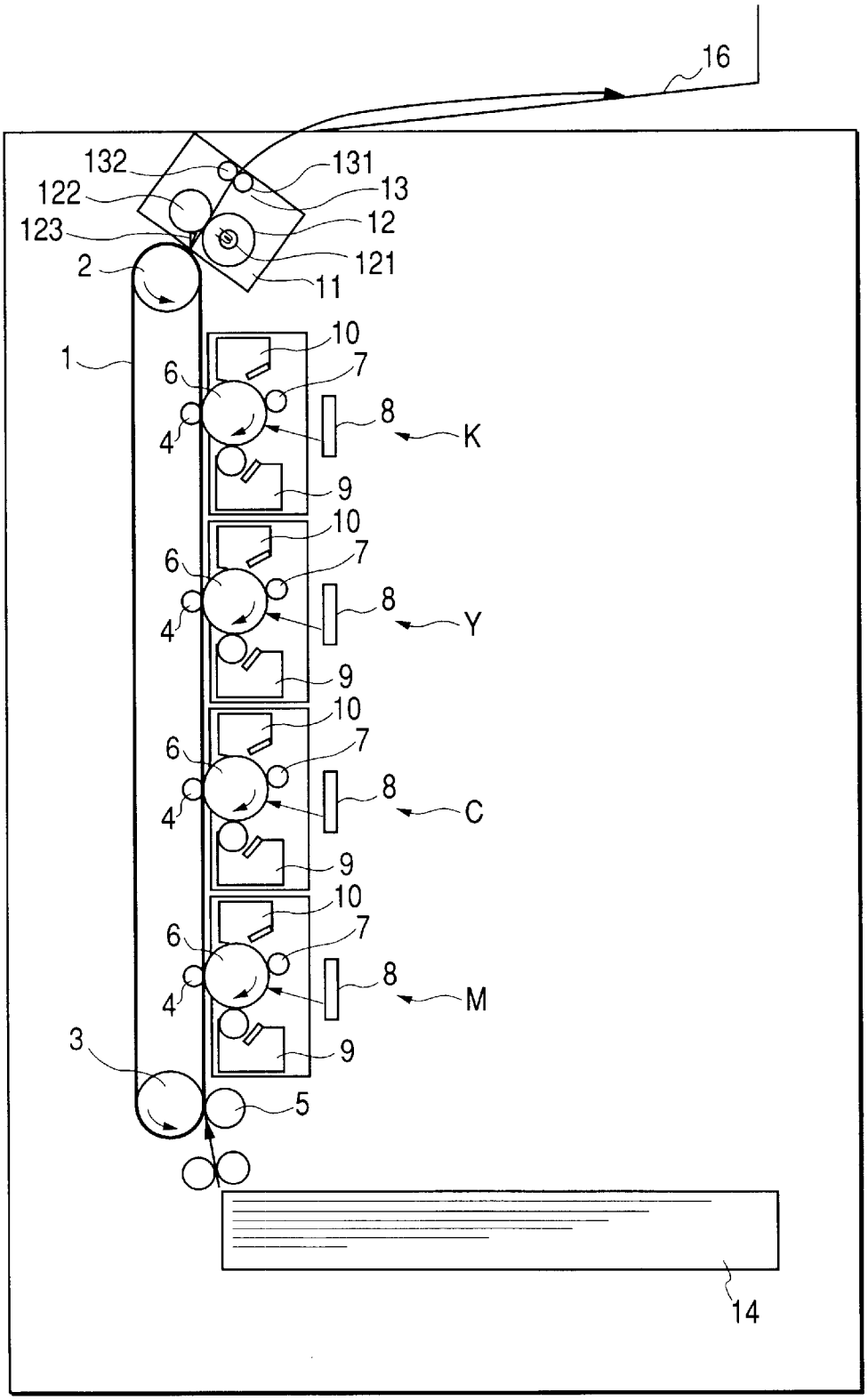
FIG. 8 is a sectional view illustrating an image forming apparatus according to a third embodiment of the present invention.

To make such a conveying path that can keep the height of the entire apparatus low without causing the transferring material to curl, the entire fixing apparatus 11 has only to be tilted to the heating roller 121 side as shown in FIG. 8. In other words, the fixing nip of the fixing part 12 and the path of the transferring material from the fixing part 12 to the sheet discharging part 13 are titled to the heating roller 121 side. In this case, however, such a tilted fixing apparatus 11 will no doubt form such a conveying path that the image sided surface of the transferring material is bent downward, that is, on the heating roller 121 side in a position just behind the fixing nip. Such a bending of the conveying path necessarily causes a hot offset.

In the embodiment, the angle θ of positioning the sheet discharging part 13 relative to the fixing part 12, that is, of positioning discharging roller pair 131, 132 relative to the heating roller 121 and the pressure roller 122 is set less than 90 degrees. Therefore, even if the fixing apparatus 11 is tilted in the above-mentioned manner, the hot offset can be prevented and hence sufficient transparency of an image on the OHP sheet can be obtained.

If the film heating type fixing apparatus is adopted, the angle θ of positioning the sheet discharging part 13 relative to the fixing part 12 has only to be set equal to or less than 85 degrees to prevent the hot offset so as to obtain sufficient transparency of the image on the OHP sheet.

Figure 9:
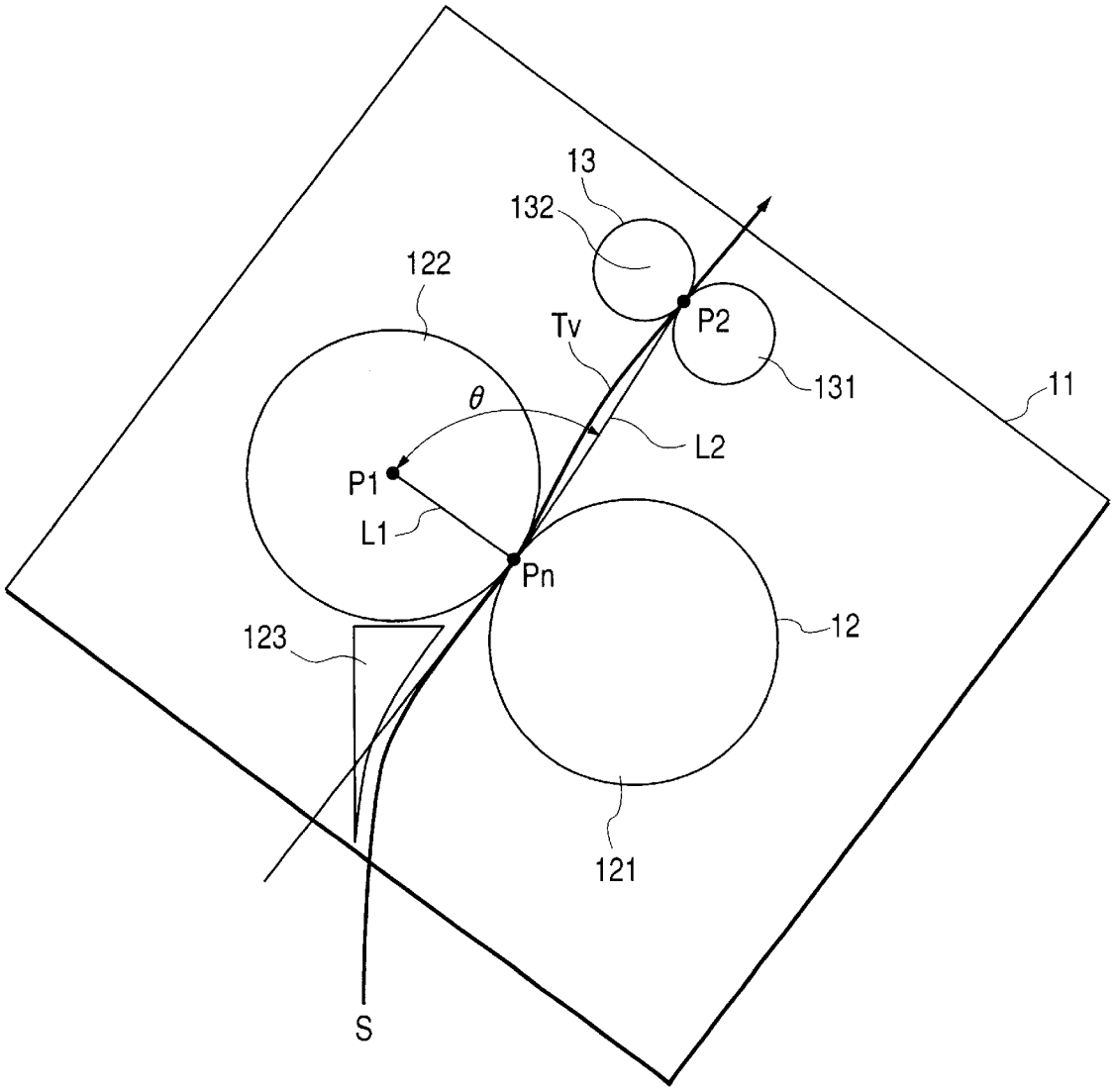
FIG. 9 is an exploded view illustrating a fixing apparatus according to the third embodiment of the present invention.

FIG. 9 is a sectional view illustrating the fixing apparatus according to this embodiment of the present invention. As shown, the OHP sheet separated from the conveying belt 1 is introduced into the fixing nip by means of a fixing entry-point guide 123. The leading end portion of the OHP sheet S discharged from the fixing nip is delivered along an extension line of the tangent line to the fixing nip in a position just after discharged, striking on the sheet discharging roller 131. At this time, since the sheet discharging roller 132 is driven, the leading end portion of the OHP sheet S is introduced into the nip between the sheet discharging roller pair of the sheet discharging part 13. The peripheral speed of the sheet discharging part 13 is set faster than that of the fixing part 12, and the force to be applied between the sheet discharging roller pair of the sheet discharging part 13 is set smaller enough than that in the fixing part 12. Therefore, the OHP sheet S is never bent on the heating roller side as well as not forcibly pulled upward from the fixing nip. Since the angle θ of position of the sheet discharging part 13 is set less than 90 degrees in the heat roller system or less than 85 degrees in the film fixing system, the OHP sheet S is steadily delivered while forming a path Tv tilted to the pressure roller 121 side until the trailing end of the OHP sheet S comes out of the nip. Thus the OHP sheet S is prevented from being bent on the heating roller 122 side and overheated. This makes it possible to prevent deterioration of the transparency of an image due to deterioration of the smoothness of the toner image sided surface, that is, deterioration of the transparency of the image due to a hot offset.

It should be noted that although the heating member of the fixing apparatus was a roller or film rotary body in the above-mentioned embodiments, the present invention should not be limited thereto. For example, a fixing member such as a heat plate can also be used as the heating member. Further, the pressure member was a roller too, but it can also be a fixing member.

The present invention should not be bound to the above-mentioned embodiments, and it includes modifications based on the same technical principles.

What is claimed is:

1. An image heating apparatus for heating an image formed on a recording material, comprising:

a heating member;

a backup member that cooperates with said heating member to form a nip for nipping and conveying the recording material; and a conveying member provided downstream of the nip in the traveling direction of the recording material, wherein, in a case that the image is formed on one side of the recording material, said heating member faces the image, said heating member is arranged at an approximate same height or at a position lower than that of said backup member, said conveying member is provided closer to said backup member than said heating member, a peripheral speed of said conveying member is faster than that of said heating member, and a force by which said conveying member nips the recording material is smaller than a force by which said heating member and said backup member cooperate with each other to nip the recording material.

2. The apparatus according to claim 1, wherein said conveying member has a pair of rotary bodies arranged in such a manner that an angle which a virtual line connecting a center of a contact portion between said pair of rotary bodies and the center of the nip forms with a virtual line connecting the center of the nip and a center of said backup member is less than 90 degrees.

3. The apparatus according to claim 1, wherein said conveying member has a pair of rotary bodies, and said heating member has such a film as to move while coming in contact with the recording material, and an angle which a virtual line connecting a center of a contact portion between said pair of rotary bodies and a center of the nip forms with a virtual line connecting the center of the nip and a center of said backup member is equal to or less than 85 degrees.

4. An image forming apparatus for forming an image on a recording material, comprising:

fixing means having a nip for nipping and conveying the recording material, said fixing means including a heating member and a backup member that cooperates with the heating member to form the nip for nipping and conveying the recording material; and a conveying member provided downstream of the nip in a traveling direction of the recording material, wherein, in a case that the image is formed on one side of the recording material, said heating member faces the image, said heating member is arranged at an approximate same height or at a position lower than that of said backup member, said conveying member is provided closer to said backup member than said heating member, a peripheral speed of said conveying member is faster than that of said heating member, and a force by which said conveying member nips the recording material is smaller than a force by which said heating member and said backup member cooperate with each other to nip the recording material.

5. The apparatus according to claim 4, wherein said conveying member has a pair of rotary bodies arranged in such a manner that an angle which a virtual line connecting a center of a contact portion between said pair or rotary bodies and a center of the nip forms with a virtual line connecting a center of the nip and the center of said backup member is less than 90 degrees.

6. The apparatus according to claim 4, wherein said conveying member has a pair of rotary bodies, and said heating member has such a film as to move while coming in contact with the recording material, and an angle which a virtual line connecting a center of a contact portion between said pair of rotary bodies and a center of the nip forms with a virtual line connecting a center of the nip and the center of said backup member is less than 85 degrees.

* * * * *

UNITED STATES PATENT AND TRADEMARK OFFICE

CERTIFICATE OF CORRECTION

PATENT NO. : 6,556,806 B2 Page 1 of 1
DATED : April 29, 2003
INVENTOR(S) : Takaaki Tsuruya et al.

It is certified that error appears in the above-identified patent and that said Letters Patent is hereby corrected as shown below:

Column 8,
Line 2, “an hot” should read -- a hot --.
Line 36, “case” should read -- cause --.

Column 9,
Line 16, “titled” should read -- tilted --.

Signed and Sealed this

Twenty-eighth Day of October, 2003

JAMES E. ROGAN
*Director of the United States Patent and Trademark Office*